US010348044B2

(12) United States Patent
Surer

(10) Patent No.: US 10,348,044 B2
(45) Date of Patent: Jul. 9, 2019

(54) OUTER CONDUCTOR ARRANGEMENT FOR A COAXIAL PLUG CONNECTOR

(71) Applicant: Rosenberger Hochfrequenztechnik GmbH & Co. KG, Fridolfing (DE)

(72) Inventor: Christian Surer, Kirchanschöring (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 16/079,341

(22) PCT Filed: Feb. 26, 2016

(86) PCT No.: PCT/EP2016/000337

§ 371 (c)(1),
(2) Date: Aug. 23, 2018

(87) PCT Pub. No.: WO2017/144070

PCT Pub. Date: Aug. 31, 2017

(65) Prior Publication Data

US 2019/0097366 A1 Mar. 28, 2019

(51) Int. Cl.

| | |
|---|---|
| ***H01R 4/62*** | (2006.01) |
| ***H01R 9/05*** | (2006.01) |
| ***H01R 24/44*** | (2011.01) |
| ***H01R 43/02*** | (2006.01) |
| ***H01R 43/16*** | (2006.01) |
| ***H01R 103/00*** | (2006.01) |

(52) U.S. Cl.

CPC ..... *H01R 24/44* (2013.01); *H01R 4/625* (2013.01); *H01R 9/0518* (2013.01); *H01R 43/02* (2013.01); *H01R 43/16* (2013.01); *H01R 2103/00* (2013.01)

(58) Field of Classification Search

CPC ..... H01R 2103/00; H01R 9/0518; H01R 9/0521; H01R 24/40; H01R 24/50; H01R 24/44; H01R 43/16; H01R 43/02; H01R 4/625

USPC ..... 439/578–585, 887

See application file for complete search history.

(56) References Cited

U.S. PATENT DOCUMENTS

| | | | |
|---|---|---|---|
| 5,217,391 | A | 6/1993 | Fisher, Jr. |
| 6,530,808 | B1 | 3/2003 | Hosler, Sr. |

(Continued)

FOREIGN PATENT DOCUMENTS

| | | | |
|---|---|---|---|
| CN | 2318742 | Y | 5/1999 |
| DE | 10315042 | A1 | 10/2003 |
| DE | 202015000750 | U1 | 2/2015 |

OTHER PUBLICATIONS

Machine Translation of CN2318742Y.

*Primary Examiner* — Gary F Paumen
(74) *Attorney, Agent, or Firm* — David P. Dickerson

(57) ABSTRACT

The invention relates to an outer conductor arrangement (4) for a coaxial connector (2). According to the invention, the outer conductor arrangement is of two-part design, comprising a contact component (6) for electrical and mechanical connection to an outer conductor of a mating connector and comprising a connection component (8, 8*a*, 8*b*) for electrical and mechanical connection to an outer conductor of a coaxial cable, wherein the contact component (6) and the connection component (8, 8*a*, 8*b*) are electrically and mechanically connected to one another at a contact section (12).

13 Claims, 5 Drawing Sheets

(56) References Cited

U.S. PATENT DOCUMENTS

| | | | | |
|---|---|---|---|---|
| 7,351,075 | B1 * | 4/2008 | Patterson | H01R 25/142 439/121 |
| 8,992,250 | B1 * | 3/2015 | Hosler, Sr. | H01R 13/622 439/322 |
| 2003/0224656 | A1 * | 12/2003 | Yoshida | H01R 9/0518 439/578 |
| 2004/0033711 | A1 * | 2/2004 | Loveless | H01R 13/213 439/314 |
| 2007/0123084 | A1 * | 5/2007 | Takehara | H01R 13/187 439/268 |
| 2008/0009204 | A1 * | 1/2008 | Wei | H01R 4/723 439/877 |
| 2013/0143430 | A1 * | 6/2013 | Sorolla Rosario | H01R 13/005 439/485 |
| 2013/0203288 | A1 * | 8/2013 | Hosler, Sr. | H01R 24/542 439/582 |
| 2013/0295786 | A1 * | 11/2013 | Dinh | H01R 24/30 439/97 |
| 2013/0316576 | A1 * | 11/2013 | Fackler | H01R 13/6315 439/578 |

* cited by examiner

OUTER CONDUCTOR ARRANGEMENT FOR A COAXIAL PLUG CONNECTOR

FIELD OF THE INVENTION

The invention relates, inter cilia, to an outer conductor arrangement for a coaxial connector.

BACKGROUND OF THE INVENTION

Coaxial connectors serve to releasably connect coaxial cables. Coaxial connectors are of coaxial design like coaxial cables, and they therefore have the advantages of coaxial cables, specifically low electromagnetic influencing and irradiation and also good electrical shielding and also an impedance that corresponds to that of the connected coaxial cable in order to avoid reflection phenomena at the transition point between the coaxial connector and the coaxial cable. In this case, a coaxial cable, also called coax cable for short, is understood to mean a two-pole cable of concentric design that has an inner conductor (also called core) that is surrounded by a hollow-cylindrical outer conductor at a constant distance. The outer conductor shields the inner conductor against electromagnetic interference radiation. An insulator or dielectric is arranged in the intermediate space between the inner conductor and the outer conductor.

Coaxial connectors are designed to provide a predetermined characteristic impedance, for example of 50Ω, in order to ensure reflection-free transmission of RF signals. The characteristic impedance of a coaxial connector depends, amongst other things, on the ratio of the inside diameter of the outer conductor and the diameter of the inner conductor. Therefore, electrical connection of a coaxial cable to a coaxial connector requires coaxial connectors that are matched to the respective inside diameter and outside diameter of the coaxial cable. However, this increases production and logistics costs, for example in the manufacture of prefabricated cable harnesses, since a multiplicity of different coaxial connectors have to be kept available for different coaxial cables. Coaxial connectors of this kind also have to satisfy different requirements in order on the one hand to establish good electrical contact and on the other hand to ensure sufficient mechanical stability. This leads to high production costs during manufacture of coaxial connectors of this kind.

BRIEF SUMMARY OF THE INVENTION

The invention is based on the object of showing a way of being able to reduce the production costs.

This object is addressed by the embodiments recited in the independent claims. Further embodiments are recited in the dependent claims.

To this end, in the case of an outer conductor arrangement for a coaxial connector, there is provision for the outer conductor arrangement to be of two-part design, comprising a contact component for electrical and mechanical connection to an outer conductor of a mating connector and comprising a connection component for electrical and mechanical connection to an outer conductor of a coaxial cable, wherein the contact component and the connection component are electrically and mechanically connected to one another at a contact section.

This has the advantage that the contact component and the connection component are produced separately from one another and can be optimized according to their respective requirements. This significantly simplifies production. Furthermore, one and the same contact component can thus be used for a multiplicity of coaxial cables of a prefabricated cable harness that are to be linked, whereas connection components matched to the respective coaxial cable that is to be linked can be used.

According to one embodiment, the contact component is connected in materially bonded fashion to the connection component. For example, the contact component can be mechanically and electrically conductively connected to the connection component by soldering or by forming an adhesive connection using electrically conductive adhesive.

According to a further embodiment, the contact component is connected in materially bonded fashion to the connection component by a welding connection. In the case of welding, no surface alloying is formed like in the case of soldering but instead a single-material connection point is provided, which is less susceptible to corrosion.

According to a further embodiment, the connection component is designed to connect the outer electrical conductor by forming a crimp connection. A crimp connection of this kind is formed by what is known as crimping. In this case, crimping is to be understood to mean a joining method in which two component parts are connected to one another by plastic deformation, for example by flanging, compression, puckering or folding.

According to a further embodiment, the contact component and/or connection component is a stamped-and-bent component. The contact component and/or connection component can thus be manufactured in large quantities in a simple manner. Stamped-and-bent components are manufactured by virtue of them being stamped out of a metal sheet, for example, directly by the coil and being brought to their final shape by bending.

According to a further embodiment, the contact component and/or connection component is produced from brass or an alloy containing brass, from tin bronze or an alloy containing tin bronze, from zinc or an alloy containing zinc, or from stainless steel or an alloy containing stainless steel. In this case, brass (CuZn) is understood here to mean copper alloys whose main constituents are the metals copper (Cu) and zinc (Zn), whereas tin bronze (CuSn) is understood to mean alloys comprising at least 60 percent copper (Cu), provided they are not to be assigned to the brasses owing to the main alloy additive of zinc (Zn) but comprise tin (Sn) as main alloy additive. Stainless steel is understood here to mean a group of corrosion-resistant and acid-resistant steel grades, for example with the material numbers 1.4571 or 1.4404.

According to a further embodiment, the contact component and the connection component are produced from a material having different thickness and/or tensile strength. The contact component and the connection component can thus each be produced from a material having a suitable thickness and tensile strength so that, for example, the connection component has optimum mechanical properties for linking an electrical conductor while the contact component has optimum electrical properties.

According to a further embodiment, the connection component has an impedance matching section matched to an inner conductor diameter. The impedance matching section has, for example, a diameter of the outer conductor in order to provide a prescribed value for the characteristic impedance, for example 50Ω. A coaxial connector with a prescribed characteristic impedance is thus provided by the connection component comprising the impedance matching section.

According to a further embodiment, the impedance matching section is arranged between the contact section of the connection component and a connection section of the connection component for the outer conductor of the coaxial cable. While the contact section is connected to the contact component, the connection section is connected to an outer conductor of a coaxial cable. A connection component comprising an impedance matching section having a particularly simple design is thus provided.

The invention also includes a contact component and a connection component for an outer conductor arrangement of this kind, a plug for a coaxial connector of this kind comprising an outer conductor arrangement of this kind, a coaxial connector having an outer conductor arrangement of this kind, and a construction kit for forming a coaxial connector of this kind.

BRIEF DESCRIPTION OF THE DRAWINGS

The invention will be explained in more detail in the following text on the basis of the drawing. In said drawing

DETAILED DESCRIPTION OF THE INVENTION

Figure 1:
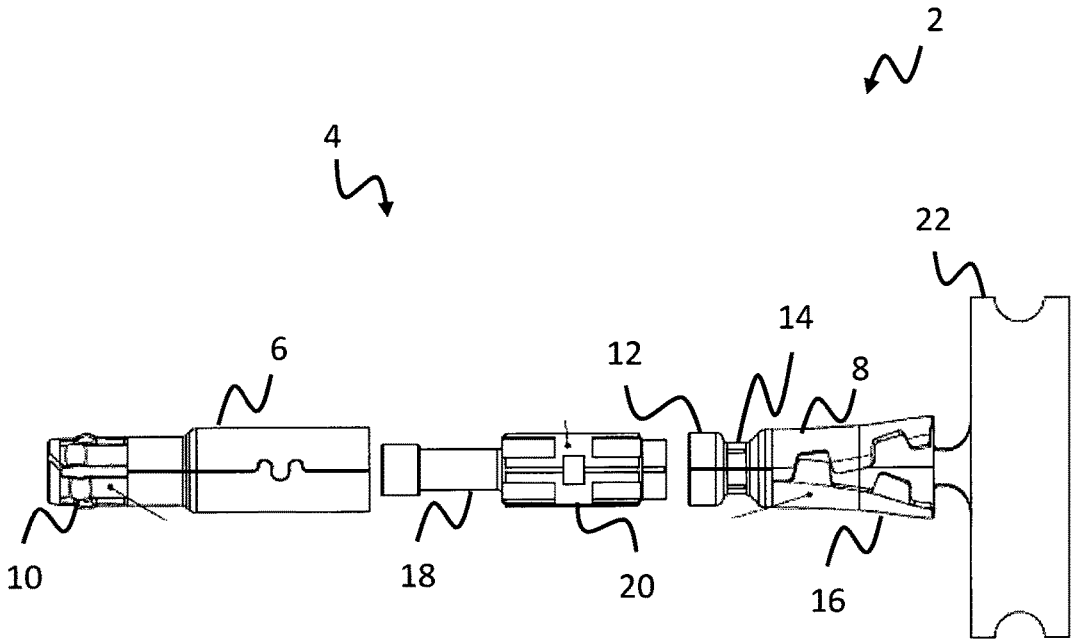
FIG. 1 shows a schematic exploded illustration of an outer conductor arrangement for a coaxial connector, consisting of a contact component and a connection component, according to one exemplary embodiment of the invention, in the unconnected state.

Reference is first made to FIG. 1.

An outer conductor arrangement 4 for a coaxial connector 2 for transmitting RF signals is illustrated.

In the present exemplary embodiment, the coaxial connector 2 is designed as an SMBA (FAKRA) connector according to standard DIN 72594-1 or USCAR-18. In the present exemplary embodiment, the coaxial connector 2 is also designed as a plug and can be plugged into an appropriate mating connector (socket or coupler) of the coaxial connector 2. As a deviation from the present exemplary embodiment, the coaxial connector 2 can also be designed as a socket or coupler.

In addition to the outer conductor arrangement 4, a coaxial connector 2 of this kind has an inner conductor 18 around which the outer conductor arrangement 4 is arranged in a concentric arrangement in order to shield the inner conductor 18 against electromagnetic interference radiation. In the present exemplary embodiment, an electrical insulator 20 is arranged between the inner conductor 18 and the outer conductor arrangement 4.

In the present exemplary embodiment, the outer conductor arrangement 4 has a contact component 6 and a connection component 8.

In the present exemplary embodiment, the contact component 6 has a plug head 10 for plugging into a socket or coupling, while the connection component 8 is designed to link an outer conductor of a coaxial cable (not illustrated) to the outer conductor arrangement 4.

In the present exemplary embodiment, the contact component 6 has a hollow-cylindrical basic shape with the plug head 10 at a first end. At the other end of the contact component 6, which other end is opposite the first end, an opening is provided, through which opening the inner conductor 18 and the insulator 20 can be inserted into the inside of the contact component 6.

In the present exemplary embodiment, the connection component 8 has a contact section 12, an impedance matching section 14 and a connection section 16 in the joining direction toward the contact component 6.

The contact section 12 is designed for insertion into the inside of the contact component 6 and for connection to the inside face of the contact component 6 in order to form an outer conductor contact. The end-side end of the contact section 12 can in this case have the function of a bearing face, which interacts with a mating bearing face inside the contact component 6 in order to bring about axial positioning of the contact component 6 in relation to the connection component 8.

In the present exemplary embodiment, the impedance matching section 14 is a tube-shaped section of the connection component 8, which has an inside diameter and an outside diameter, which are each measured in such a way that, in the present exemplary embodiment, together with the inner conductor 18, a characteristic impedance of 50Ω is provided. The connection component 8 also has in the region of the impedance matching section 14 an outside diameter constricted portion, which can also have the function of a latching edge for forming a latching connection, using which the connection component 8 is connected to the contact component 6 in order to likewise bring about axial positioning of the contact component 6 in relation to the connection component 8.

The connection section 16 of the connection component 8 is designed to connect an outer electrical conductor of a coaxial cable by forming a crimp connection. The connection section 16 also has a tensile relief means 22 for mechanically fixing an insulation means of an outer conductor of a coaxial cable.

In the present exemplary embodiment, the contact component 6 and the connection component 8 are produced from brass or an alloy containing brass, from tin bronze or an alloy containing tin bronze, from zinc or an alloy containing zinc, or from stainless steel or an alloy containing stainless steel. In this case, in the present exemplary embodiment, the contact component 6 and the connection component 8 are produced from the same material. The outer conductor arrangement 4 comprising the contact component 6 and the connection component 8 can thus also be referred to as single-material. However, the materials from which the contact component 6 and the connection component 8 are produced have different thicknesses or material thicknesses and tensile strengths. The contact component 6 can thus be produced from a first material with a thickness and tensile strength that ensure particularly good electrical contact while the connection component 8 can thus be produced from a second material with a thickness and tensile strength that ensure particularly good mechanical contact.

In the present exemplary embodiment, the contact component 6 and the connection component 8 are each a stamped-and-bent component. Stamped-and-bent components are manufactured by virtue of them being stamped out of a metal sheet, for example, directly by the coil and being brought to their final shape by bending.

Figure 2:
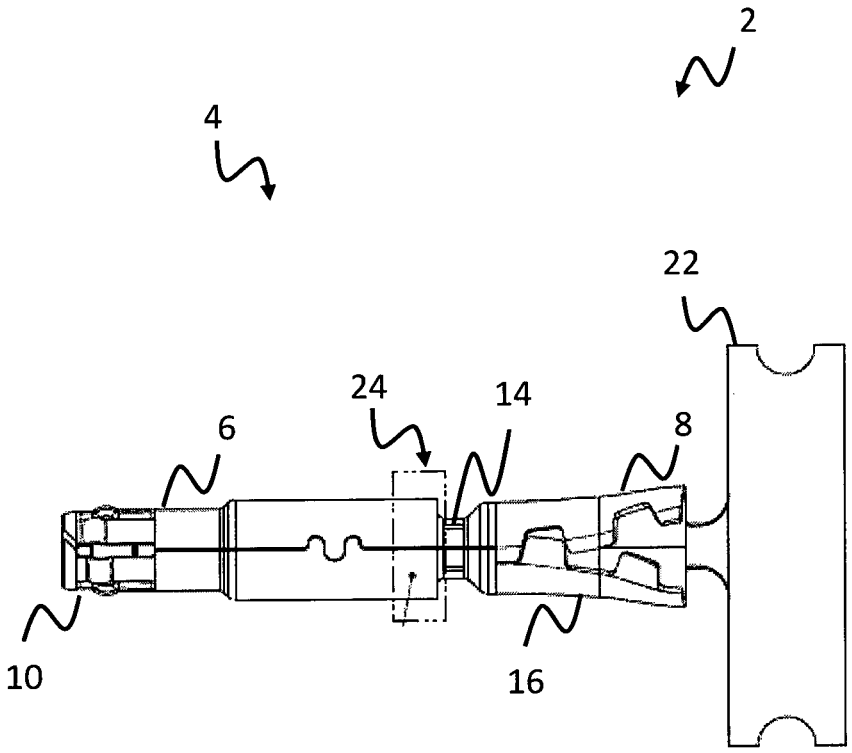
FIG. 2 shows the outer conductor arrangement illustrated in FIG. 1 for a coaxial connector in the connected state.

Reference is now also made to FIG. 2.

FIG. 2 shows the outer conductor arrangement 4 for a coaxial connector 2, wherein the contact component 6 is connected in materially bonded fashion to the connection component 8 in the present exemplary embodiment by a welding connection 24, after the inner conductor 18 and the insulator 20 have been inserted. In the present exemplary embodiment, therefore, in addition to the contact component 6 and the connection component 8, the welding connection 24 is also of single-material design.

Figure 3:
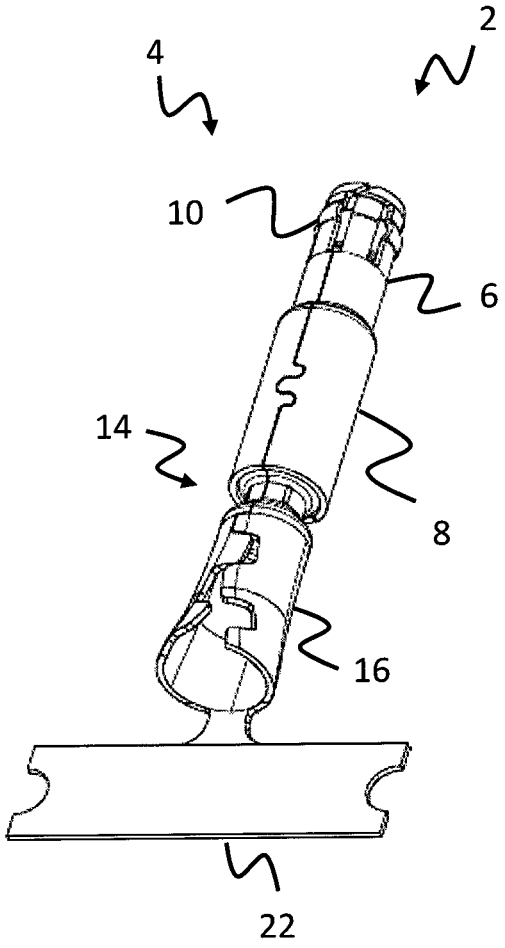
FIG. 3 shows a perspective illustration of the outer conductor arrangement illustrated in FIG. 2 for a coaxial connector.

Reference is now also made to FIG. 3.

FIG. 3 shows the fully assembled outer conductor arrangement 4 for linking to an outer conductor of a coaxial cable.

Figure 4:
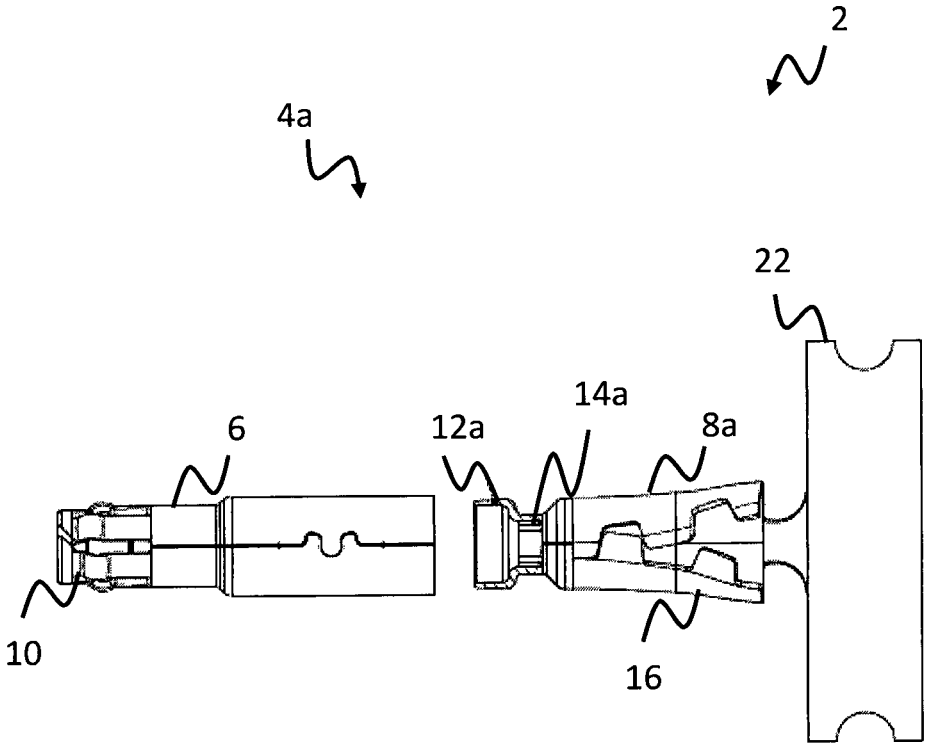
FIG. 4 shows a schematic exploded illustration of an outer conductor arrangement for a coaxial connector, consisting of a contact component and a connection component for linking an electrical line having a first diameter.
Figure 5:
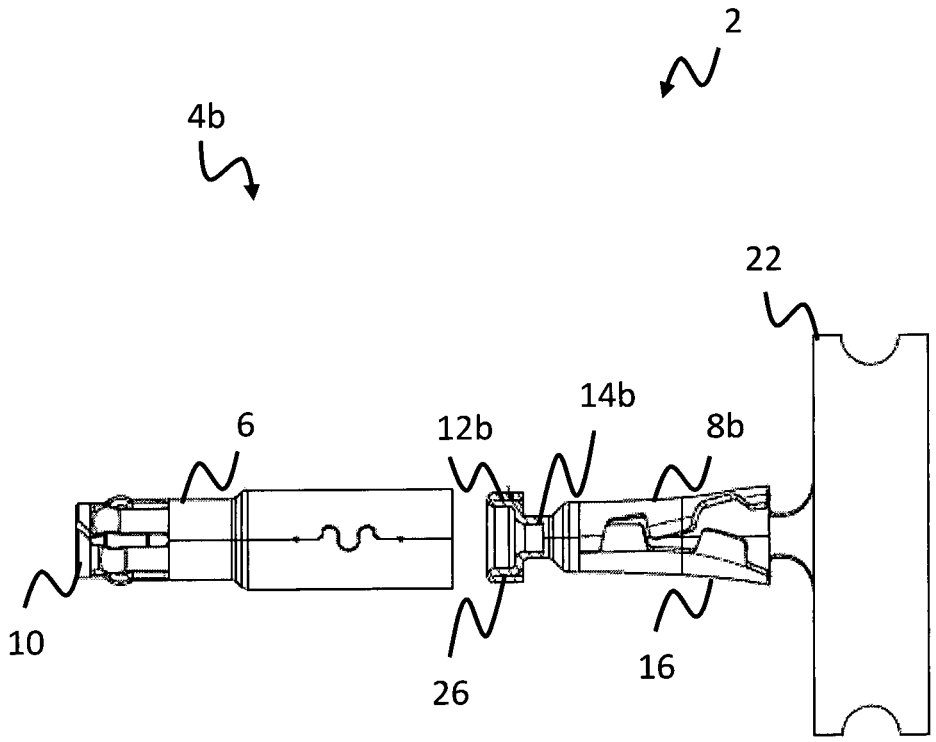
FIG. 5 shows a schematic exploded illustration of an outer conductor arrangement for a coaxial connector, consisting of the contact component illustrated in FIG. 4 and a connection component for linking an electrical line having a second, smaller diameter.

Reference is now also made to FIG. 4 and FIG. 5, which together show a construction kit for forming a coaxial connector 2.

While FIG. 4 shows an outer conductor arrangement 4*a* for a coaxial connector 2 comprising a first connection component 8*a* for linking a coaxial cable having a first outer conductor diameter and a first inner conductor diameter, FIG. 5 shows an outer conductor arrangement 4*b* for a coaxial connector 2 comprising a second connection component 8*b* for linking a coaxial cable having a second outer conductor diameter and a second inner conductor diameter, wherein the second diameters are smaller than the first diameters.

The contact components 6 of the respective outer conductor arrangements 4*a*, 4*b* for coaxial connectors 2 are each of identical design. However, the first connection component 8*a* and the second connection component 8*b* are of different design. It can thus be seen with reference to FIGS. 4 and 5 that the first impedance matching section 14*a* of the outer conductor arrangement 4*a* for the first inner conductor diameter has a greater inside diameter and outside diameter than the second impedance matching section 14*b* of the outer conductor arrangements 4*b* for the second inner conductor diameter. This makes it possible to achieve a situation in which, in both cases, a prescribed characteristic impedance of 50Ω is provided since matching to the diameters of inner and outer conductors of the coaxial cable that is to be linked is effected by the respective inside diameter and outside diameter of the first impedance matching section 14*a* and of the second impedance matching section 14*b*.

FIG. 5 also shows that, in contrast to the first contact section 12*a* of the first connection component 8*a*, the second contact section 12*b* of the connection component 8*b* in the present exemplary embodiment has a compensation section 26, which is formed in the present exemplary embodiment by an edge that is folded in a simple manner. As an alternative, the compensation section 26 can also be formed by an additional component, for example a ring, which is fitted onto the second contact section 12*b*.

The compensation section 26 in the present exemplary embodiment is formed by virtue of a sheet-metal section of the second contact section 12*b* being provided with a fold and being bent. In the present exemplary embodiment, the compensation section 26 is folded over once. In the present exemplary embodiment, the material thickness of the second contact section 12*b* is thus doubled. As an alternative, there may also be provision for the corresponding material section to be embossed before the folding in order to reduce the material thickness thereof. However, there may also be provision for multiple folding in order to multiply the material thickness accordingly.

The compensation section 26 results in the second contact section 12*b* of the connection component 8*b* having essentially the same outside diameter as the first contact section 12*a* of the first connection component 8*a* even though the inside diameters thereof are different. "Having essentially the same outside diameter" is understood in this case to mean that the outside diameter of the second contact section 12*b* of the second connection component 8*b* is in the range of production tolerances of the first contact section 12*a* of the first connection component 8*a*. In contrast, without the folded-over compensation section 26, the second contact section 12*b* of the second connection component 8*b* would have a reduced outside diameter due to the required smaller inside diameter, with the result that no sufficiently secure contact from the second contact section 12*b* of the second connection component 8*b* in the contact component 6 would be provided.

The different first impedance matching section 14*a* and the second impedance matching section 14*b* as well as the compensation section 26 thus permit the use of identically designed contact components 6, wherein coaxial cables having different outside diameters, outer conductor diameters and inner conductor diameters can be linked respectively to the first connection component 8*a* and the second connection component 8*b*.

The invention claimed is:

1. A coaxial connector outer conductor assembly, comprising:

a first outer conductor component; and a second outer conductor component comprising a contact portion, wherein said first outer conductor component is electrically and mechanically coupled to an outer circumference of said contact portion, said first outer conductor component is of a material selected from the group consisting of tin bronze and an alloy comprising tin bronze, and said second outer conductor component is of a material selected from the group consisting of stainless steel and an alloy comprising stainless steel.

2. The outer conductor assembly of claim 1, comprising:

said first outer conductor is metallurgically bonded to said second outer conductor component.

3. The outer conductor assembly of claim 1, comprising:

a weld that mechanically couples said first outer conductor component to said second outer conductor component.

4. The outer conductor assembly of claim 1, wherein:

said second outer conductor component is distinct from said first outer conductor component.

5. The outer conductor assembly of claim 1, wherein:

said first outer conductor component comprises a connector engagement portion electrically and mechanically coupleable to an outer conductor of a counterpart connector, and said second outer conductor component comprises a cable engagement portion electrically and mechanically coupleable to an outer conductor of a coaxial cable.

6. The outer conductor assembly of claim 2, wherein:

said second outer conductor component comprises an impedance adjustment portion intermediate said contact portion and said cable engagement portion, said impedance adjustment portion having an outer diameter that is smaller than an outer diameter of said contact portion and is smaller than an outer diameter of said cable engagement portion.

7. The outer conductor assembly of claim 1, wherein:

said first outer conductor component is formed from a single piece of sheet metal.

8. The outer conductor assembly of claim 1, wherein:

said second outer conductor component is formed from a single piece of sheet metal.

9. A coaxial connector comprising:

a first connector component comprising a first inner conductor and a first outer conductor; and a second connector component comprising a second inner conductor and a second outer conductor assembly, said second outer conductor assembly comprising:

a first outer conductor component; and a second outer conductor component comprising a contact portion, wherein said first outer conductor component is electrically and mechanically coupled to an outer circumference of said contact portion, said first outer conductor component is of a material selected from the group consisting of tin bronze and an alloy comprising tin bronze, and said second outer conductor component is of a material selected from the group consisting of stainless steel and an alloy comprising stainless steel.

10. A coaxial connector outer conductor assembly method, comprising:

providing a first outer conductor component of a first material selected from the group consisting of tin bronze and an alloy comprising tin bronze, providing a second outer conductor component of a second material selected from the group consisting of stainless steel and an alloy comprising stainless steel, and coupling said first outer conductor component electrically and mechanically to an outer circumference of a contact portion of said second outer conductor component.

11. The method of claim 10, wherein:

said providing a first outer conductor component comprises:

stamping a blank from a sheet of said first material, and forming said first outer conductor component from said blank.

12. The method of claim 10, wherein:

said providing a second outer conductor component comprises:

stamping a blank from a sheet of said second material, and forming said second outer conductor component from said blank.

13. The method of claim 10, comprising:

welding said first outer conductor component to said second outer conductor component.

* * * * *